US005773183A

United States Patent [19]

Doujo et al.

[11] Patent Number: 5,773,183

[45] Date of Patent: Jun. 30, 1998

[54] TONER FOR DEVELOPING ELECTROSTATIC IMAGES

[75] Inventors: Tadashi Doujo, Kawasaki; Yuichi Mizoo, Toride; Takaaki Kotaki, Yokohama; Yushi Mikuriya, Kawasaki, all of Japan

[73] Assignee: Canon Kabushiki Kaisha, Tokyo, Japan

[21] Appl. No.: 749,640

[22] Filed: Nov. 15, 1996

[30] Foreign Application Priority Data

Nov. 20, 1995 [JP] Japan ..... 7-323564

[51] Int. Cl.[6] ..... G03G 9/087

[52] U.S. Cl. ..... 430/106; 430/110

[58] Field of Search ..... 430/106, 109, 430/110

[56] References Cited

U.S. PATENT DOCUMENTS

| | | | |
|---|---|---|---|
| 2,297,691 | 10/1942 | Carlson . | |
| 5,468,585 | 11/1995 | Matsumoto et al. | 430/110 |
| 5,483,327 | 1/1996 | Taya et al. | 430/110 |
| 5,489,498 | 2/1996 | Ohno et al. | 430/110 |
| 5,578,409 | 11/1996 | Kotaki et al. | 430/109 |

FOREIGN PATENT DOCUMENTS

| | | | |
|---|---|---|---|
| 0495476 | 7/1992 | European Pat. Off. | G03G 9/087 |
| 0606873 | 7/1994 | European Pat. Off. | G03G 9/087 |
| 0621513 | 10/1994 | European Pat. Off. | G03G 9/097 |
| 0662638 | 7/1995 | European Pat. Off. | G03G 9/08 |
| 0662642 | 7/1995 | European Pat. Off. | G03G 9/087 |
| 43-24748 | 10/1968 | Japan . | |
| 3-188468 | 9/1988 | Japan | G03G 9/087 |
| 63-225244 | 9/1988 | Japan | G03G 9/08 |
| 63-225245 | 9/1988 | Japan | G03G 9/08 |
| 63-225246 | 9/1988 | Japan | G03G 9/08 |
| 42-23910 | 11/1997 | Japan . | |

OTHER PUBLICATIONS

Patent Abstracts of Japan, vol. 15, No. 449 (P–1275), Nov. 1991 of JP 3–118468.

*Primary Examiner*—John Goodrow

*Attorney, Agent, or Firm*—Fitzpatrick, Cella, Harper & Scinto

[57] ABSTRACT

A toner for developing an electrostatic image has a binder resin, a colorant and a charge control agent. The binder resin has a polyester resin having an acid value of from 15 to 40 and a hydroxyl value of 45 or less. The toner has, in its molecular weight distribution as measured by gel permeation chromatography, tetrahydrofuran-soluble matter having a weight average molecular weight Mw of 100,000 or more, having a ratio of weight average molecular weight Mw to number average molecular weight Mn, Mw/Mn, of not less than 35, containing from 70% to 94% of a low-molecular weight region component having a molecular weight of less than 150,000, containing from 1% to 10% of a medium-molecular weight region component having a molecular weight of from 150,000 to 500,000, and containing from 5% to 25% of a high-molecular weight region component having a molecular weight of more than 500,000. The high-molecular weight region component is more than the medium-molecular weight region component.

22 Claims, 2 Drawing Sheets

TONER FOR DEVELOPING ELECTROSTATIC IMAGES

BACKGROUND OF THE INVENTION

1. Field of the Invention

This invention relates to a toner for developing electrostatic images, used in image forming processes such as electrophotography, electrostatic recording or electrostatic printing.

2. Related Background Art

A number of methods are conventionally known for electrophotography, as disclosed in U.S. Pat. No. 2,297,691, Japanese Patent Publication No. 42-23910 and No. 43-24748 and so forth. In general, copied images are obtained by forming an electrostatic image on a photosensitive member by utilizing a photoconductive material and by various means, subsequently developing the electrostatic image by the use of a toner to form a toner image, and transferring the toner image to a transfer medium such as paper if necessary, followed by fixing by the action of heat, pressure, heat and pressure, or solvent vapor.

As methods for fixing toner images to a sheet such as paper as a final step in the above process, a fixing method most commonly available at present is the pressure heat system using a heat roller.

This system is a method of fixing toner images by causing a toner image side of an image-receiving sheet to pass the surface of a heat roller whose surface is formed of a material having releasability to toner while the former is brought into contact with the latter under application of a pressure.

Since in this method the surface of the heat roller comes into contact with the toner image of the image-receiving sheet under application of a pressure, a very good thermal efficiency can be achieved when the toner image is melt-adhered onto the image-receiving sheet, so that the fixing can be carried out rapidly.

In this method, however, since the surface of the heat roller comes into contact with the toner image in a molten state under pressure, part of toner images may adhere and transfer to the surface of a fixing roller, and may again transfer to the subsequent image-receiving sheet to cause the phenomenon of offset, thereby bringing about the problem of contamination of the image-receiving sheet. Accordingly, the toner is required to have good low-temperature fixing performance and high-temperature anti-offset properties.

In the past, a variety of toners have been proposed so that both the fixing performance at the time of low-temperature fixing and the anti-offset properties at the time of high-temperature fixing can be achieved at the same time. For example, Japanese Patent Application Laid-open No. 63-225244 to No. 63-225246 disclose a toner containing two types of non-linear polyesters for the purpose of improving low-temperature fixing performance, high-temperature anti-offset properties and blocking resistance. However, as a toner having a fixing temperature range broad enough to be applicable from low speed to high speed and having good anti-offset properties, there is room for further improvement conjointly with the image characteristics discussed later.

Japanese Patent Application Laid-open No. 3-188468 also discloses a toner that fulfills the following conditions (A) to (C):

(A) when an acid value of a polyester resin is represented by Av, and a hydroxyl value by OHv, Av is within the range of from 20 to 35 KOH mg/g, and Av/OHv =1.0 to 1.5;

(B) tetrahydrofuran-insoluble matter is in a content not more than 10%; and (C) in molecular weight distribution by gel permeation chromatography (GPC) of tetrahydrofuran-soluble matter, the weight average molecular weight Mw and the number average molecular weight Mn is in a proportion of Mw/Mn $\geqq$10, at least one peak (low-molecular weight side peak) is present in the region of number average molecular weight of from 3,000 to 8,000, at least one peak or shoulder (high-molecular weight side peak) is present in the region of number average molecular weight of from 100,000 to 600,000, and the region of the high-molecular weight side peak holds 5 to 15%. However, the polyester resin specifically disclosed in Examples in Japanese Patent Application Laid-open No. 3-188468 has a value of weight average molecular weight which is as small as 40,000 to 80,000 and a value of Mw/Mn which is also as small as 13.3 to 16.6, and hence, it is necessary to further improve the low-temperature fixing performance and high-temperature anti-offset properties.

In recent years, it is sought to make copied images have a higher image quality by making toner particles finer. Making toner particles finer enables improvement in resolution and sharpness of images, but causes various problems.

First, making toner particles finer results in a poor fixing performance at halftone image areas. This is because the toner is deposited at the halftone image areas in a small quantity, and hence the toner transferred to concave portions of the image-receiving sheet receives a very small quantity of heat applied from the heat roller, and also receives an insufficient fixing pressure because the pressure is held back by the convex portions of the image-receiving sheet. The toner transferred to the convex portions of the image-receiving sheet at its halftone image areas has a small thin toner layer thickness, and hence the shear force applied to each toner particle is much larger than that applied at solid black areas having a large toner layer thickness, so that the phenomenon of offset may occur or copied images may have a poor image quality.

There is also the problem of fog. Making toner particle diameters smaller results in an increase in surface area per unit weight of toner particles, and hence the toner has a very broad charge quantity distribution, tending to cause fog. Because of the increase in surface area per unit weight of toner particles, the charging performance of toner becomes susceptible to changes in the environment.

It is sought to provide a toner having better solved the above various problems.

SUMMARY OF THE INVENTION

An object of the present invention is to provide a toner for developing electrostatic images that has solved the above problems.

Another object of the present invention is to provide a toner for developing electrostatic images that has superior low-temperature fixing performance and high-temperature anti-offset properties.

Still another object of the present invention is to provide a toner for developing electrostatic images that shows superior fixing performance even at halftone image areas.

A further object of the present invention is to provide a small particle size toner for developing electrostatic images that has low-temperature fixing performance and high-temperature anti-offset properties.

A still further object of the present invention is to provide a toner for developing electrostatic images that has a superior environmental stability.

The present invention provides a toner for developing an electrostatic image, comprising a binder resin, a colorant and a charge control agent, wherein;

the binder comprises a polyester resin; the polyester resin having an acid value of from 15 to 40 and a hydroxyl value of 45 or less; and the toner has, in its molecular weight distribution as measured by gel permeation chromatography (GPC), tetrahydrofuran(THF)-soluble matter having a weight average molecular weight (Mw) of 100,000 or more, having a ratio of weight average molecular weight (Mw) to weight average molecular number (Mn), Mw/Mn, of not less than 35, containing from 70% to 94% of a low-molecular weight region component having a molecular weight of less than 150,000, containing from 1% to 10% of a medium-molecular weight region component having a molecular weight of from 150,000 to 500,000, and containing from 5% to 25% of a high-molecular weight region component having a molecular weight of more than 500,000; the high-molecular weight region component being more than the medium-molecular weight region component.

DESCRIPTION OF THE PREFERRED EMBODIMENTS

Figure 1:
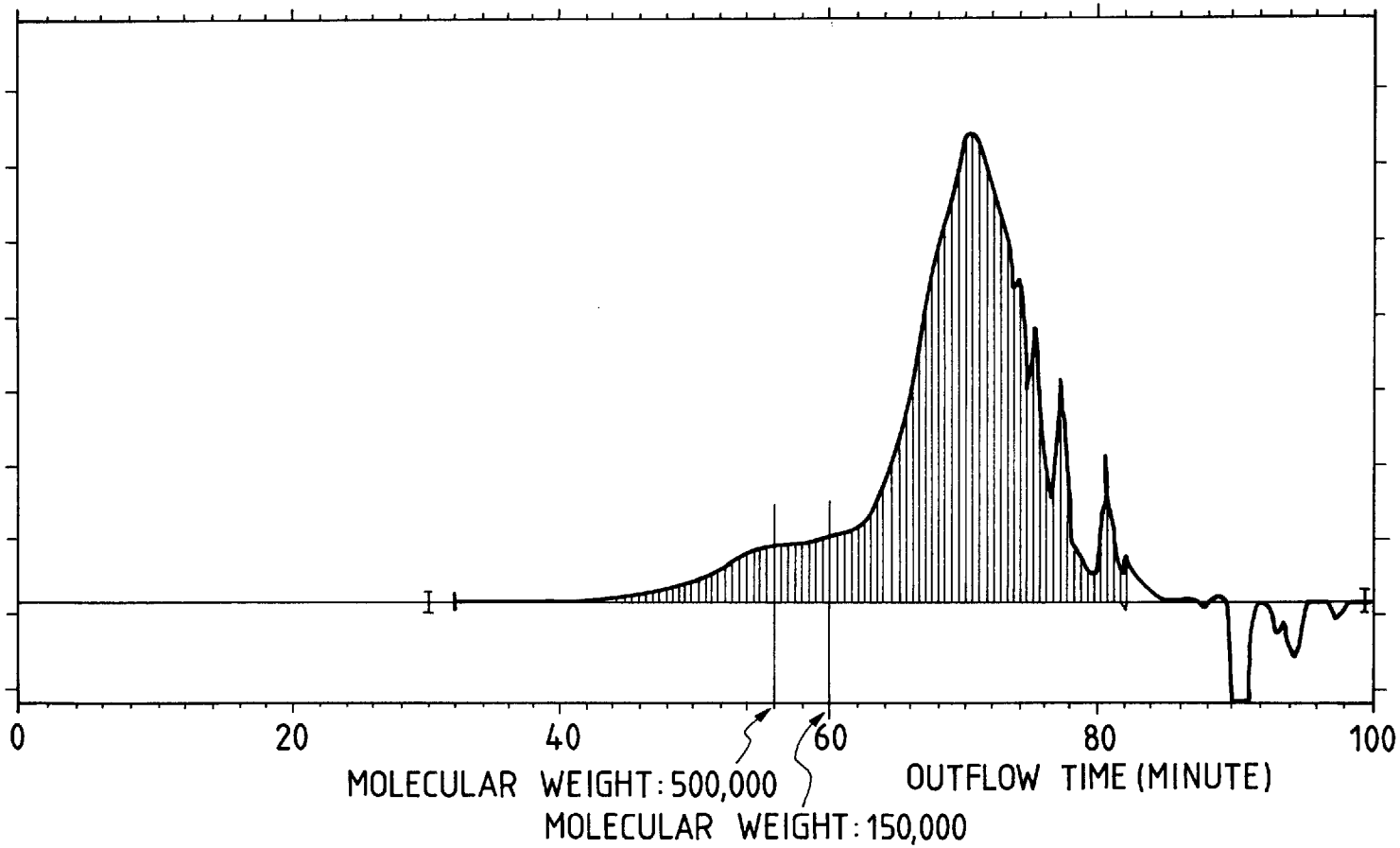
FIG. 1 shows a GPC chart of THF-soluble matter of a toner obtained in Example 1.

The toner of the present invention is constituted basically of a binder resin polyester resin, a colorant and a charge control agent. In the toner of the present invention, its molecular weight distribution is made optimum so as to fulfill the following conditions (a) to (f) in gel permeation chromatography (GPC) of tetrahydrofuran(THF)-soluble matter of the polyester resin in the toner.

(a) Weight average molecular weight (Mw) is 100,000 or more, and preferably from 200,000 to 3,000,000;

(b) the ratio of weight average molecular weight (Mw) to number average molecular weight (Mn), Mw/Mn, is not less than 35, and preferably from 40 to 400;

(c) from 70% to 94% of a low-molecular weight region component having a molecular weight of less than 150,000 is contained;

(d) from 1% to 10% of a medium-molecular weight region component having a molecular weight of from 150,000 to 500,000 is contained;

(e) from 5% to 25% of a high-molecular weight region component having a molecular weight of more than 500,000 is contained; and (f) the high-molecular weight region component is more than the medium-molecular weight region component, and preferably the high-molecular weight region component is more than the medium-molecular weight region component by 1 to 20%.

If the above conditions are not fulfilled, either the low-temperature fixing performance or the high-temperature anti-offset properties will be damaged. If the low-molecular weight component has a smaller proportion than the above, the low-temperature fixing performance will be damaged. If the high-molecular weight component has a smaller proportion than the above or Mw is smaller than 100,000, the high-temperature anti-offset properties will be damaged. If the medium-molecular weight component has a larger proportion than the above or Mw/Mn is smaller than 35, both the low-temperature fixing performance and the high-temperature anti-offset properties will be damaged. THF-insoluble matter of the polyester resin may inhibit low-temperature fixing performance, and hence the THF-insoluble matter of the resin component in the toner may preferably be in a content not more than 10% by weight. More preferably the resin component may contain no THF-insoluble matter, or may contain it in an amount not more than 5% by weight.

As methods for making the molecular weight distribution of the polyester resin in the toner fulfill the above conditions, it is preferable to use as a material resin a polyester resin containing THF-insoluble matter and cut this THF-insoluble matter by heat and shear force in the step of kneading when the toner is produced, to thereby form the high-molecular weight component. If, however, any cross-linkable component is contained in the toner materials in this step, cross-linking reaction may take place between the polyester resin and the cross-linkable component at the time of kneading to cause an increase in the high-molecular weight component and medium-molecular weight component, resulting in a lowering of the low-temperature fixing performance. Chromium complex compounds commonly used as charge control agents that impart negative chargeability to toners tend to cause the cross-linking during kneading as herein stated. Hence, it is preferable to use organic metal compounds other than chromium complexes. In particular, azo type iron complexes are not cross-linkable with the polyester resin at the time of kneading, and hence make it possible to achieve optimum molecular weight distribution.

As the polyester resin in the toner, a polyester resin having an acid value of from 15 to 40 and a hydroxyl value of 45 or less is used. If it has an acid value less than 15, image density tends to decrease as a result of continuous copying in an environment of low humidity, and also fog tends to occur. If it has an acid value more than 40, image density tends to lower in an environment of high humidity, probably because of a too great action of charge relaxation. If the polyester resin has a hydroxyl value more than 45, image density tends to lower in an environment of high humidity. It may preferably have a hydroxyl value of from 5 to 42.

The polyester resin used in the present invention may preferably be composed as described below.

In the polyester resin used in the present invention, 40 to 60 mol % in the all components are held by an alcohol component, and 60 to 40 molt by an acid component.

As the alcohol component, it may include diols such as ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, a bisphenol derivative represented by the following Formula (A);

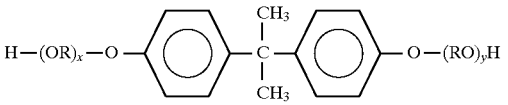

(A)

wherein R represents an ethylene group or a propylene group, x and y are each an integer of 1 or more, and an average value of x+y is 2 to 10;

and a diol represented by the following Formula (B).

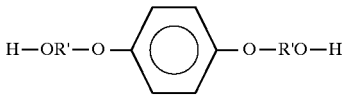

(B)

wherein R' represents —$CH_2CH_2$—,

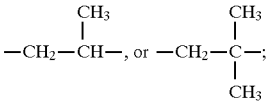

As a dibasic carboxylic acid component that holds 50 mol % or more in the whole acid component, it may include benzene dicarboxylic acids and anhydrides thereof, such as phthalic acid, terephthalic acid, isophthalic acid and phthalic anhydride; alkyldicarboxylic acids such as succinic acid, adipic acid, sebacic acid and azelaic acid, and anhydrides thereof; succinic acids substituted with an alkenyl or alkyl group having 6 to 18 carbon atoms, or anhydrides thereof; unsaturated dicarboxylic acids such as fumaric acid, maleic acid, citraconic acid and itaconic acid, or anhydrides thereof. It may also include polyhydric alcohols such as glycerol, pentaerythritol, sorbitol, sorbitan, and oxyalkylene ethers of novolak type phenol resin; and polycarboxylic acids such as as trimellitic acid, pyromellitic acid, benzophenonetetracarboxylic acid or anhydride thereof.

ing no THF-insoluble matter and a second polyester resin containing in a large quantity a high-molecular weight component containing THF-insoluble matter may be used in the form of a mixture. This makes it easy to control molecular weight distribution, and is preferred.

The first polyester resin contains the THF-insoluble matter in an amount of 0% by weight, and may preferably have THF-soluble matter having Mw of from 7,000 to 100,000 and Mn of from 2,000 to 10,000.

The second polyester resin contains the THF-insoluble matter in an amount of from 10 to 50% by weight, and may preferably have THF-soluble matter having Mw of from 30,000 to 500,000 and Mn of from 2,500 to 15,000.

The first polyester resin and the second polyester resin may preferably be mixed in a weight ratio of from 1:9 to 9:1, and more preferably from 2:8 to 8:2, so as to be used as a material for the binder resin before the toner is produced.

The azo type iron complex compound used in the present invention may preferably be a compound having a structure represented by the following formula.

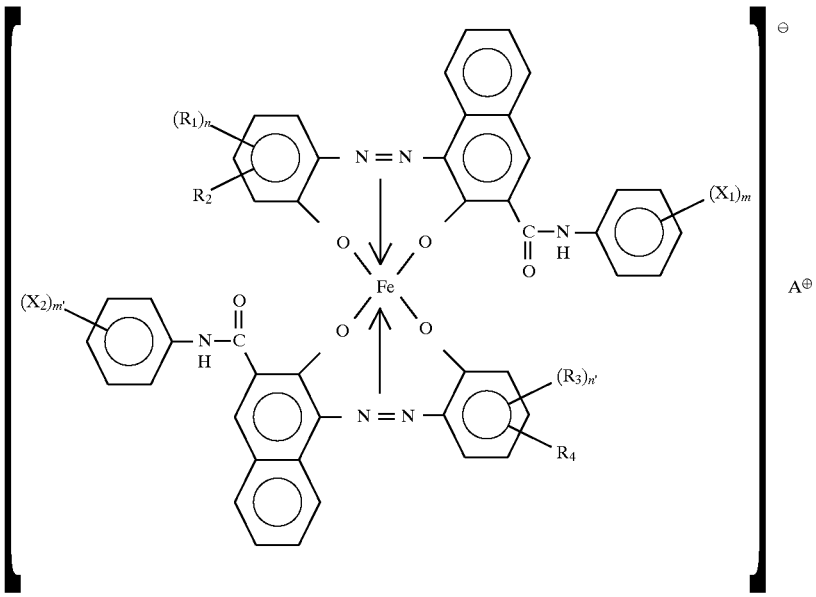

An alcohol component of the polyester resin which is particularly preferred in working the present invention is the bisphenol derivative represented by the above Formula (A). As the acid component, dicarboxylic acids or anhydrides thereof, such as phthalic acid, terephthalic acid, isophthalic acid and anhydrides thereof, succinic acid, n-dodecenylsuccinic acid or anhydrides thereof, fumaric acid, maleic acid and maleic anhydride are preferred. As a cross-linking component, it may preferably include trimellitic anhydride, benzophenone tetracarboxylic acid, pentaerythritol, and oxyalkylene ethers of novolak type phenol resin.

The polyester resin may have a glass transition temperature (Tg) of from 40° to 80° C., and preferably from 45° to 75° C. As previously described, the polyester resin may preferably contain THF-insoluble matter that is made into a THF-soluble high-molecular weight component in the step of kneading when the toner is produced, and may contain it in an amount of from 5 to 30% by weight, and preferably from 10 to 25% by weight.

In order to preferably attain the molecular weight distribution as defined in the present invention, after the toner particles are formed, a first polyester resin containing in a large quantity a low-molecular weight component contain-wherein $X_1$ and $X_2$ each represent a hydrogen atom, a lower alkyl group, a lower alkoxyl group, a nitro group or a halogen atom, and $X_1$ and $X_2$ may be the same or different from each other; m and m' each represent an integer of 1 to 3; $R_1$ and $R_3$ each represent a hydrogen atom, an alkyl group having 1 to 18 carbon atoms, an alkenyl group, a sulfonamide group, a mesyl group, a sulfonic acid group, a carboxylate group, a hydroxyl group, an alkoxyl group having 1 to 18 carbon atoms, an acetylamino group, a benzoylamino group or a halogen atom, and $R_1$ and $R_3$ may be the same or different from each other; n and n' each represent an integer of 1 to 3; $R_2$ and $R_4$ each represent a hydrogen atom or a nitro group; and $A^+$ represents a hydrogen ion, a sodium ion, a potassium ion or an ammonium ion.

The azo type iron complex compound is used as a negative charge control agent. The azo type iron complex compound can be synthesized by known means.

The negative charge control agent may be used alone or in combination of two or more kinds.

As typical examples of the azo type iron complex compound represented by the above formula, it may include the following compounds.

Azo type iron complex compound (1)
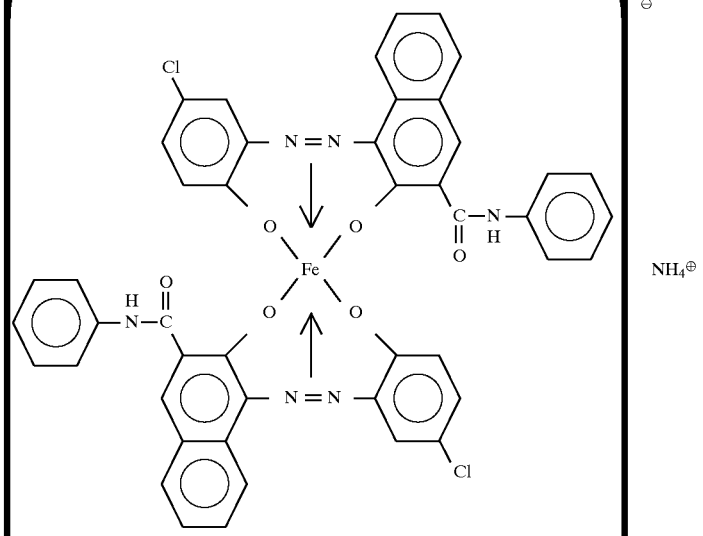
Azo type iron complex compound (2)
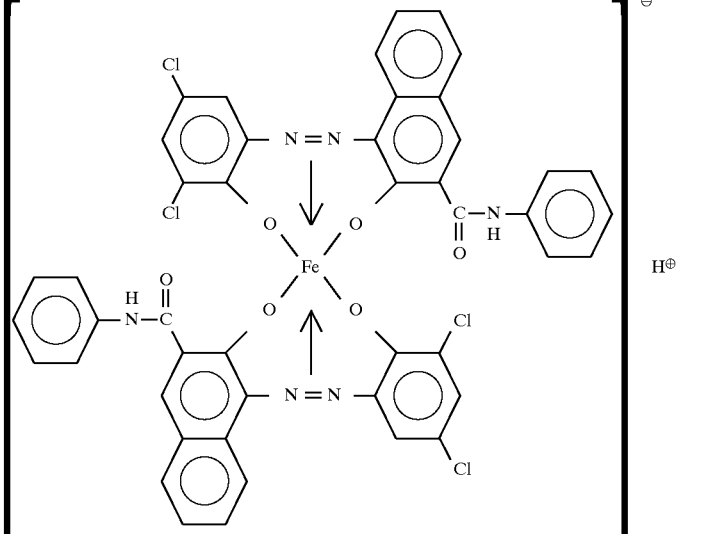
Azo type iron complex compound (3)
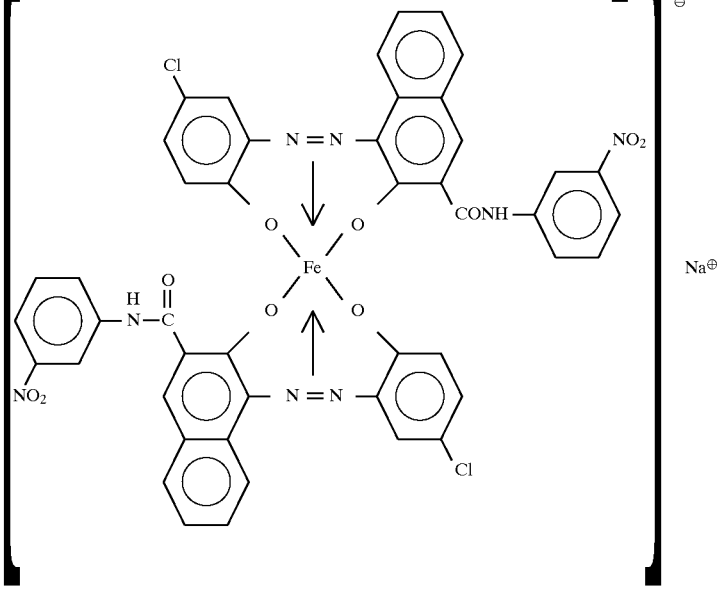

-continued
Azo type iron complex compound (4)
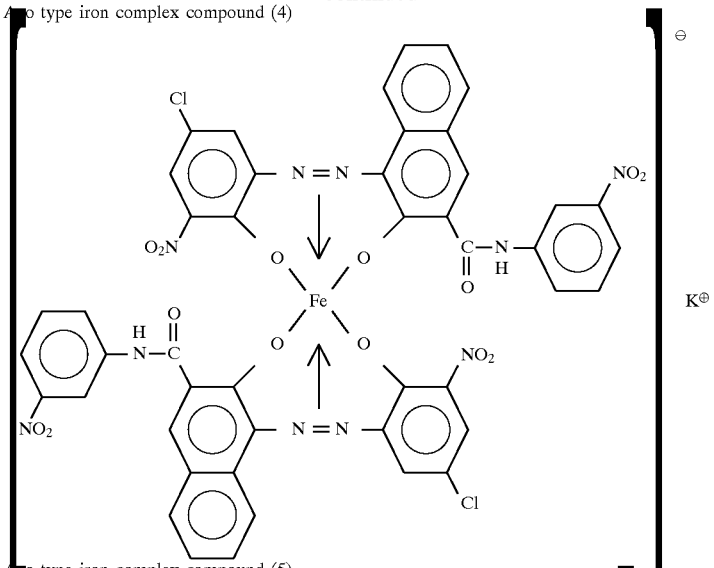
Azo type iron complex compound (5)
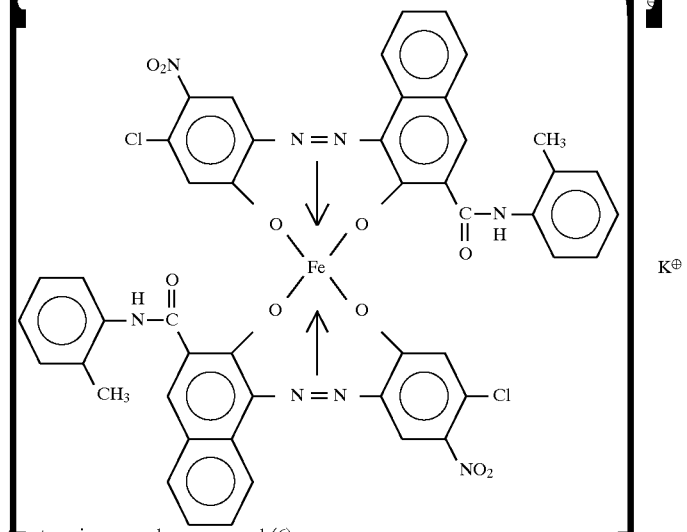
Azo type iron complex compound (6)
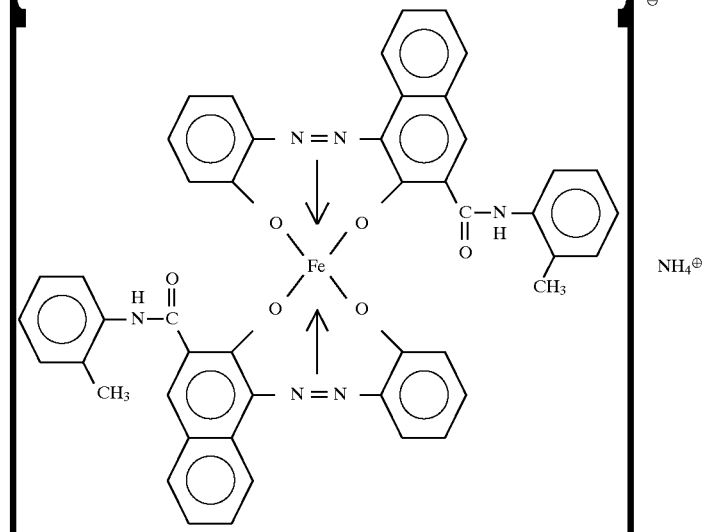

The toner for developing electrostatic images according to the present invention may preferably contain the azo type iron complex compound of the above formula in an amount of from 0.1 to 10 parts by weight, and more preferably from 0.1 to 5 parts by weight, based on 100 parts by weight of the binder resin.

When the toner of the present invention is used as a magnetic toner, the magnetic toner contains a magnetic material which may include iron oxides such as magnetite, hematite and ferrite; iron oxides containing other metal oxides; metals such as Fe, Co and Ni, or alloys of any of these metals with any of metals such as Al, Co, Cu, Pb, Mg, Ni, Sn, Zn, Sb, Be, Bi, Cd, Ca, Mn, Se, Ti, W and V, and mixtures of any of these.

As the magnetic material, triion tetraoxide ($Fe_3O_4$), iron sesquioxide ($\gamma$-$Fe_2O_3$), zinc iron oxide ($ZnFe_2O_4$), yttrium iron oxide ($Y_3Fe_5O_{12}$), cadmium iron oxide ($CdFe_2O_4$), gadolinium iron oxide ($Gd_3Fe_5O_{12}$), copper iron oxide ($CuFe_2O_4$), lead iron oxide ($PbFe_{12}O_{19}$), nickel iron oxide ($NiFe_2O_4$), neodymium iron oxide ($NdFe_2O_3$), barium iron oxide ($BaFe_{12}O_{19}$), magnesium iron oxide ($MgFe_2O_4$), manganese iron oxide ($MnFe_2O_4$), lanthanum iron oxide ($LaFeO_3$), iron powder (Fe), cobalt powder (Co), nickel powder (Ni) and so forth are known in the art. According to the present invention, any of the above magnetic materials may be selected and used alone or in combination of two or more kinds. A magnetic material particularly preferred for the object of the present invention is fine powder of triion tetraoxide or $\gamma$-iron sesquioxide.

These magnetic materials may preferably be those having an average particle diameter of from 0.1 to 2 $\mu$m, and more preferably from 0.1 to 0.5 $\mu$m, and a coercive force of from 1.5 kA/m to 12 kA/m, a saturation magnetization of from 50 to 200 $Am^2/kg$ (preferably from 50 to 100 $Am^2/kg$) and residual magnetization of from 2 to 20 $Am^2/kg$, as magnetic properties under application of a magnetic field of 795.8 kA/m.

The magnetic material may be used in an amount of from 10 to 200 parts by weight, and preferably from 20 to 150 parts by weight, based on 100 parts by weight of the binder resin.

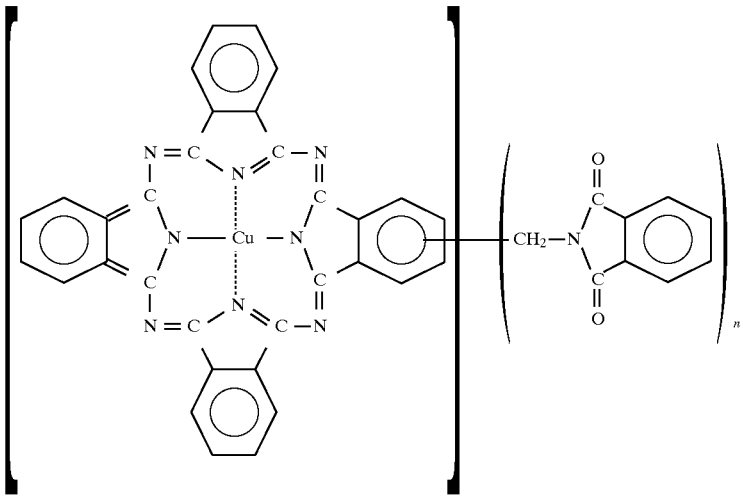

As colorants, carbon black, titanium white, and other pigments and/or dyes may be further used. For example, when the toner of the present invention is used as a color toner, the dyes include C.I. Direct Red 1, C.I. Direct Red 4, C.I. Acid Red 1, C.I. Basic Red 1, C.I. Mordant Red 30, C.I. Direct Blue 1, C.I. Direct Blue 2, C.I. Acid Blue 9, C.I. Acid Blue 15, C.I. Basic Blue 3, C.I. Basic Blue 5, C.I. Mordant Blue 7, C.I. Direct Green 6, C.I. Basic Green 4 and C.I. Basic Green 6. The pigments include chrome yellow, cadmium yellow, mineral first yellow, navel yellow, Naphthol Yellow S, Hanza Yellow G, Permanent Yellow NCG, Tartrazine Lake, chrome orange, molybdenum orange, Permanent Orange GTR, Pyrazolone Orange, Benzidine Orange G, cadmium red, Permanent Red 4R, Watchung Red calcium salt, eosine lake, Brilliant Carmine 3B, manganese violet, Fast Violet B, Methyl Violet Lake, prussian blue, cobalt blue, Alkali Blue Lake, Victoria Blue Lake, Phthalocyanine Blue, Fast Sky Blue, Indanthrene Blue BC, chrome green, Pigment Green B, Malachite Green Lake and Final Yellow Green G.

When the toner of the present invention is used as two-component full-color image forming toners, the colorant may include those as shown below. As a magenta coloring pigment, it may include C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 49, 50, 51, 52, 53, 54, 55, 57, 58, 60, 63, 64, 68, 81, 83, 87, 88, 89, 90, 112, 114, 122, 123, 163, 202, 206, 207, 209, C.I. Pigment Violet 19, and C.I. Vat Red 1, 2, 10, 13, 15, 23, 29, 35.

The pigment may be used alone. From the viewpoint of image quality of full-color images, it is more preferable to use the pigment and the dye in combination so that the sharpness of images can be improved. As a magenta dye, it may include oil-soluble dyes such as C.I. Solvent Red 1, 3, 8, 23, 24, 25, 27, 30, 49, 81, 82, 83, 84, 100, 109, 121, C.I. Disperse Red 9, C.I. Solvent Violet 8, 13, 14, 21, 27, and C.I. Disperse Violet 1; basic dyes such as C.I. Basic Red 1, 2, 9, 12, 13, 14, 15, 17, 18, 22, 23, 24, 27, 29, 32, 34, 35, 36, 37, 38, 39, 40, and C.I. Basic Violet 1, 3, 7, 10, 14, 15, 21, 25, 26, 27, 28.

As other coloring pigments, a cyan coloring pigment may include C.I. Pigment Blue 2, 3, 15, 16, 17; C.I. Vat Blue 6; C.I. Acid Blue 45, or copper phthalocyanine pigments whose phthalocyanine skeleton has been substituted with 1 to 5 phthallmide methyl group(s) as represented by the formula:

As a yellow coloring pigment, it may include C.I. Pigment Yellow 1, 2, 3, 4, 5, 6, 7, 10, 11, 12, 13, 14, 15, 16, 17, 23, 65, 73, 83, and C.I. Vat Yellow 1, 3, 20.

The colorant may be used in an amount of from 0.1 to 60 parts by weight, and preferably from 0.5 to 50 parts by weight, based on 100 parts by weight of the binder resin.

In the present invention, it is preferable for the toner particles to optionally contain at least one kind of release agent.

The release agent usable in the present invention may include the following: Aliphatic hydrocarbon waxes such as low-molecular weight polyethylene, low-molecular weight polypropylene, microcrystalline wax and paraffin wax, oxides of aliphatic hydrocarbon waxes such as polyethylene wax oxide, and block copolymers of these; waxes mainly composed of a fatty acid ester, such as carnauba wax, sasol wax and montanic acid ester wax, or those obtained by subjecting part or the whole of a fatty acid ester composition to deoxidation treatment, such as deoxidized carnauba wax. It may also include saturated straight-chain fatty acids such as palmitic acid, stearic acid and montanic acid; unsaturated fatty acids such as brassidic acid, eleostearic acid and parinaric acid; saturated alcohols such as stearyl alcohol, aralkyl alcohol, behenyl alcohol, carnaubyl alcohol, ceryl alcohol and melissyl alcohol; polyhydric alcohols such as sorbitol; fatty acid amides such as linolic acid amide, oleic acid amide and lauric acid amide; saturated fatty acid bisamides such as methylenebis(stearic acid amide), ethylenebis(capric acid amide), ethylenebis(lauric acid amide) and hexamethylenebis(stearic acid amide); unsaturated fatty acid bisamides such as ethylenebis(oleic acid amide), hexamethylenebis(oleic acid amide), N,N'-dioleyladipic acid amide and N,N'-dioleylsebacic acid amide; aromatic bisamides such as m-xylenebis(stearic acid amide) and N,N'-distearylisophthalic acid amide; fatty acid metal salts (commonly what is called metal soap) such as calcium stearate, calcium laurate, zinc stearate and magnesium stearate; grafted waxes obtained by graft-polymerizing vinyl monomers such as styrene or acrylic acid to aliphatic hydrocarbon waxes; partially esterified products of polyhydric alcohols with fatty acids, such as monoglyceride behenate; and methyl esterified products having a hydroxyl group, obtained by hydrogenation of vegetable fats and oils.

Waxes particularly preferably used in the present invention may include aliphatic hydrocarbon waxes, as exemplified by low-molecular weight alkylene polymers obtained by radical polymerization of an alkylene under a high pressure or by polymerization thereof under a low pressure in the presence of a Ziegler catalyst; alkylene polymers obtained by thermal decomposition of a high-molecular weight alkylene polymer; and synthetic hydrocarbon waxes obtained by hydrogenating the distillation residue of hydrocarbons prepared by the Arge process from a synthesis gas containing carbon monoxide and hydrogen. Those obtained through fractionation of hydrocarbon waxes by a fractional crystallization system utilizing press-sweating, solvent dewaxing or vacuum distillation are preferably used. The hydrocarbon, serving as a matrix, may include those synthesized by reacting carbon monoxide with hydrogen in the presence of a metal oxide type catalyst (usually formed of two or more kinds of catalysts), as exemplified by hydrocarbon compounds synthesized by the Synthol method or the Hydrocol process (making use of a fluidized catalyst bed); hydrocarbons having about several hundred carbon atoms obtained by the Arge process (making use of a fixed catalyst bed), which provides waxy hydrocarbons in a large quantity; and hydrocarbons obtained by polymerizing alkylenes such as ethylene in the presence of a Ziegler catalyst. These are preferable as having less and small branches and being saturated long straight chain hydrocarbons. In particular, waxes synthesized by the method not relying on the polymerization of alkylenes are preferred in view of their molecular weight distribution.

In the molecular weight distribution of the wax, a main peak may be present in the region of molecular weight of from 400 to 2,400, preferably from 450 to 2,000, and particularly preferably from 500 to 1,600. The wax having such a molecular weight distribution can impart preferable thermal properties to the toner.

The release agent may preferably be used in an amount of from 0.1 to 20 parts by weight, and more preferably from 0.5 to 10 parts by weight, based on 100 parts by weight of the binder resin.

The release agent is incorporated into the binder resin usually by a method in which a resin is dissolved in a solvent and, raising the temperature of the resin solution, the release agent is added and mixed therein with stirring, or a method in which they are mixed at the time of kneading so as to be incorporated into the binder resin.

As a negatively chargeable fluidity-improving agent that may be used in the toner of the present invention, it may include an agent which can improve the fluidity of the toner by its external addition to toner particles. For example, it may include fluorine resin powders such as fine vinylidene fluoride powder and fine polytetrafluoroethylene powder; fine silica powders such as wet-process silica and dry-process silica, and surface-treated silica obtained by subjecting these fine silica powders to surface treatment with a silane coupling agent, a titanium coupling agent, silicone oil or the like.

A preferred fluidity-improving agent is fine powder produced by vapor phase oxidation of a silicon halide, which is called dry process silica or fumed silica. For example, it is a process that utilizes heat decomposition oxidation reaction in the oxygen and hydrogen of silicon tetrachloride gas. The reaction basically proceeds as follows.

$$SiCl_4+2H_2+O_2 \rightarrow SiO_2+4HCl$$

In this production step, it is also possible to use other metal halide such as aluminum chloride or titanium chloride together with the silicon halide to give a composite fine powder of silica with other metal oxide. The fine silica powder of the present invention includes these, too. As to its particle diameter, it is preferable to use fine silica powder having an average primary particle diameter within the range of from 0.001 to 2 $\mu$m, and particularly preferably within the range of from 0.002 to 0.2 $\mu$m.

Commercially available fine silica powders produced by the vapor phase oxidation of a silicon halide, include, for example, those which are on the market under the following trade names.

Aerosil 130, 200, 300, 380, TT600, MOX80, $MOX_1$70, COK84 (Aerosil Japan, Ltd.);

Ca-O-SiL M-5, MS-7, MS-75, HS-5, EH-5 (CABOT Co.);

Wacker HDK N 20, V15, N20E, T30, T40 (WACKER-CHEMIE GMBH);

D-C Fine Silica (Dow-Corning Corp.); and

Fransol (Fransil Co.).

It is also preferable to use treated fine silica powder obtained by making hydrophobic the fine silica powder produced by vapor phase oxidation of a silicon halide. In the treated fine silica powder, a fine silica powder is particularly preferred which has been so treated that its hydrophobicity as measured by methanol titration shows a value within the range of from 30 to 80.

As methods for making hydrophobic, the fine silica powder may be made hydrophobic by chemical treatment with an organosilicon compound capable of reacting with or physically adsorbing the fine silica powder. As a preferable method, the fine silica powder produced by vapor phase oxidation of a silicon halide may be treated with an organosilicon compound.

The organosilicon compound may include hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylchlorosilane, bromomethyldimethylchlorosilane, α-chlorothyltrichlorosilane, β-chloroethyltrichlorosilane, chloromethyldimethylchlorosilane, triorganosilyl mercaptan, trimethylsilyl mercaptan, triorganosilyl acrylate, vinyldimethylacetoxysilane, dimethylethoxysilane, dimethyldimethoxysilane, diphenyldiethoxysilane, hexamethyldisiloxane, 1,3-divinyltetramethyldisiloxane, 1,3-diphenyltetramethyldisiloxane, and a dimethylpolysiloxane having 2 to 12 siloxane units per molecule and containing a hydroxyl group bonded to each Si in its units positioned at the terminals. Any of these may be used alone or in the form of a mixture of two or more kinds.

As the fluidity-improving agent, those having a specific surface area of 30 $m^2/g$ or above, and preferably 50 $m^2/g$ or above, as measured by the BET method using nitrogen absorption provides good results. The fluidity-improving agent may preferably be used in an amount of from 0.01 to 8 parts by weight, and preferably from 0.1 to 4 parts by weight, based on 100 parts by weight of the toner.

The toner for developing electrostatic images according to the present invention can be produced by highly mixing the binder resin, the colorant and/or magnetic material, the charge control agent and other additives by means of a mixing machine such as a Henschel mixer or a ball mill, thereafter melt-kneading the mixture by means of a heat kneading machine such as a kneader or an extruder to well mix resins to make them melt together, and then cooling the melt-kneaded product to solidify, followed by pulverization and classification. Thus the toner of the present invention can be obtained.

The fluidity-improving agent and the toner may be further well mixed by means of a mixing machine such as a Henschel mixer, whereby a toner having the fluidity-improving agent on the toner particle surfaces can be obtained.

The molecular weight and molecular weight distribution of THF-soluble matter of the toner, the acid value, the hydroxyl value, the proportion of THF-insoluble matter and the glass transition temperature are measured by the methods as described below.

(1) Measurement of molecular weight:

The molecular weight of chromatogram as measured by gel permeation chromatography (GPC) is measured in the following way.

Columns are stabilized in a heat chamber of 40° C. To the columns kept at this temperature, tetrahydrofuran (THF) as a solvent is flowed at a flow rate of 1 ml per minute. Toner is dispersed and dissolved in THF. Thereafter, the solution obtained is left to stand overnight, and then filtered with a 0.2 μm filter to obtain a filtrate, which is used as a sample. Concentration of the sample is adjusted to 0.05 to 0.6% by weight, and 50 to 200 μl of the resin THF solution obtained is injected to make measurement. In measuring the molecular weight of the sample, the molecular weight distribution ascribed to the sample is calculated from the relationship between the logarithmic value and count number of a calibration curve prepared using several kinds of monodisperse polystyrene standard samples. As the standard polystyrene samples used for the preparation of the calibration curve, it is suitable to use, e.g., samples with molecular weights of from $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$ and $4.48\times10^6$, which are available from Pressure Chemical Co. or Toso Co., Ltd., and to use at least about 10 standard polystyrene samples. An RI (refractive index) detector is used as a detector.

A combination of a plurality of commercially available polystyrene gel columns may preferably be used so that molecular weight regions of 1,000 to 2,000,000 can be accurately measured. For example, they may preferably comprise a combination of μ-Styragel 500, $10^3$, $10^4$ and $10^5$, available from Waters Co., or a combination of Shodex KA-801, KA-802, KA-803, KA-804, KA-805, KA-806 and KA-807, available from Showa Denko K.K.

(2) Measurement of acid value and OH value:

Measurement of acid value:

The acid value is measured in the following way according to JIS K0070-1966.

In a 200 to 300 ml Erlenmeyer flask, 2 to 10 g of a sample is weighed and taken, followed by addition of about 50 ml of a 50:50 mixed solvent of acetone and toluene to dissolve the sample. Using a 0.1% mixed reagent of Bromothymol Blue and Phenol Red, titration is made in N/10 potassium hydroxide-alcohol solution previously standardized, and the acid value is calculated from the consumption of the alcohol potassium hydroxide solution according the following expression.

Acid value=

KOH (ml number)×N×5.61/sample weight wherein N represents a factor of N/10 KOH.

Measurement of hydroxyl value:

The hydroxyl value is measured in the following way according to JIS K0070-1966.

In a 200 ml Erlenmeyer flask, about 2 g of a sample is precisely weighed at 1 mg units, a solution of 1:4 mixture of acetic anhydride and pyridine is added thereto using a 5 ml holepipet, followed by further addition of 25 ml of pyridine using a messcylinder. A condenser is attached to the Erlenmeyer flask, and reaction is carried out for 90 minutes in a 100° C. oil bath.

From the top of the condenser, 3 ml of distilled water is added, and its contents are well shaked and then left to stand for 10 minutes. The Erlenmeyer flask to which the condenser is kept attached is drawn up from the oil bath, and left to cool. After it has cooled to about 30° C., the condenser and the mouth of flask are washed with a small amount of acetone (about 10 ml) from the top opening of the condenser. Then, 50 ml of THF is added using a messcylinder, and neutralization titration is carried out using an alcohol solution of phenolphthalein as an indicator by adding a N/2 KOH-THF solution and using a 50 ml buret (graduation: 0.1 ml). Immediately before the end point of neutralization, 25 ml of neutral alcohol (methanol/acetone=1/1 volume ratio) is added to carry out titration until the solution turns slightly red. A blank test is also made at the same time.

Next, the hydroxyl value is determined according to the following expression.

$$\textit{Hydroxyl value (mg KOH/g)}=[\{(B-A)\times f\times 28.05\}/S]+C$$

where;

A: the number of ml of the N/2 KOH-THF solution required in the present test;

B: the number of ml of the N/2 KOH-THF solution required in the blank test;

f: factor of the N/2 KOH-THF solution;

S: weight (g) of the sample taken; and

C: acid value or alkali value, provided that the acid value is plus and the alkali value is minus.

(3) Proportion of THF-insoluble matter:

Polyester resin or toner is weighed, which is then put in a cylindrical filter paper (e.g., No. 86R; size: 28×10 mm; available from Toyo Roshi K.K.) and set on a Soxhlet extractor. Extraction is carried out for 6 hours using 200 ml of THF as a solvent. Here, the extraction is carried out at such a reflux rate that the THF extraction cycle is at intervals of about 4 to 5 minutes. After the extraction is completed, the cylindrical filter paper is taken out, followed by weighing to obtain the insoluble matter of polyester resin.

In the case when the toner contains THF-insoluble matter such as magnetic material or pigment other than the resin component, the weight of the toner put in the cylindrical filter paper is regarded as $W_1$ g, the weight of the THF-soluble matter extracted is regarded as $W^2$ g and the weight of the THF-insoluble matter other than the resin component contained in the toner is regarded as $W_3$ g, where the content of THF-insoluble matter of the resin component in the toner is determined according to the following expression.

$$\textit{THF-insoluble matter}\ (\%)=[\{W_1-(W_3+W_2)\}/(W_1-W_3)]\times 100$$

Figure 2:
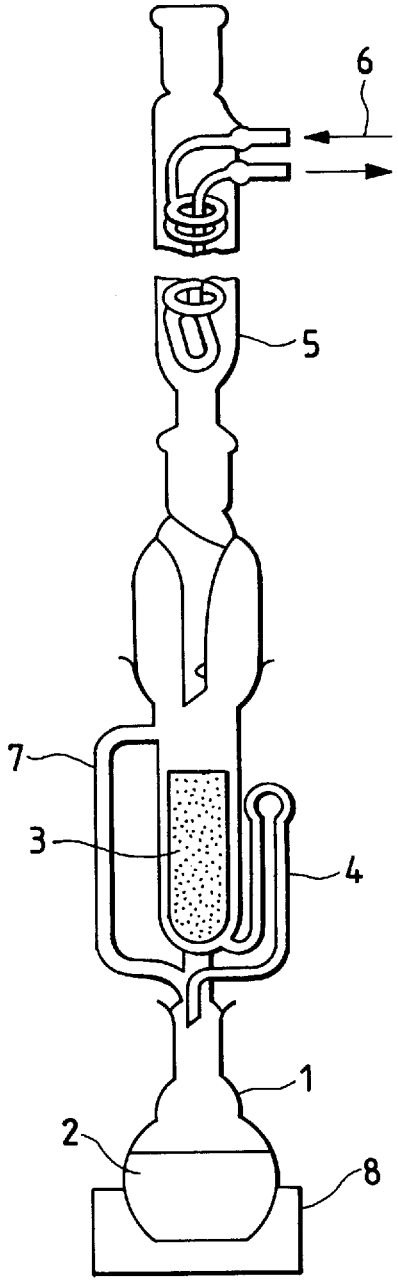
FIG. 2 is a schematic illustration of an extractor used in Soxhlet extraction.

An example of the Soxhlet extractor is shown in FIG. 2. THF 2 put in a container 1 is heated by a heater 8 to evaporate. The THF having evaporated passes through a pipe 7 and is lead into a condenser 5. The condenser 5 is always cooled with cooling water 6. THF cooled and liquefied in the condenser 5 is collected at a collecting part having a cylindrical filter paper 3. Once the liquid level of THF becomes higher than an intermediate pipe 4, the THF is discharged out of the collecting part. The toner held in the cylindrical filter paper is extraction treated by the circulating THF.

(4) Glass transition temperature Tg:

The glass transition point is measured using a differential thermal analyzer (DSC measuring device), DSC-7 (manufactured by Perkin-Elmer Inc.), according to ASTM D3418-82.

A sample to be measured is precisely weighed in a quantity of 5 to 20 mg, and preferably 10 mg. This sample is put in an aluminum pan. Using an empty aluminum pan as a reference, the measurement is made in an environment of normal temperature and normal humidity at a measuring temperature range between 30° C. and 200° C., raised at a rate of 100° C./min. During this temperature rise, an endothermic peak of the main peak in the range of temperatures 40° C. to 100° C. is obtained. The point at which the line at a middle point of the base lines before and after appearance of the endothermic peak and the differential thermal curve intersect is regarded as the glass transition point Tg.

The present invention will be described below by giving resin production examples and working examples. The present invention is by no means limited to only these examples.

Resin Production Example 1

| | |
|---|---|
| Terephthalic acid | 10 mol % |
| Fumaric acid | 25 mol % |
| Trimellitic anhydride | 5 mol % |
| Bisphenol derivative represented by Formula (A) | |
| (R: propylene group; x + y = 2.2) | 35 mol % |
| (R: ethylene group; x + y = 2.2) | 25 mol % |

The above materials were charged in a 5 liter four-necked flask, and a reflux condenser, a water separator, an N2 gas feed pipe, a thermometer and a stirrer were provided thereto. While feeding N2 gas into the flask, polycondensation reaction was carried out at 230° C. to obtain first polyester resin A, having Mn of 2,500, Mw of 10,000, Tg of 57° C., THF-insoluble matter of 0% by weight, acid value of 28 and hydroxyl value of 40.

| | |
|---|---|
| Fumaric acid | 32 mol % |
| Trimellitic anhydride | 10 mol % |
| Bisphenol derivative represented by Formula (A) | |
| (R: propylene group; x + y = 2.2) | 35 mol % |
| (R: ethylene group; x + y = 2.2) | 23 mol % |

Next, using the above monomers, polycondensation reaction was carried out in the same manner as the above, but further adding 2 molt of trimellitic anhydride in the course of the polymerization, to obtain second polyester resin B, having Mn of 3,500, Mw of 150,000, Tg of 63° C., THF-insoluble matter of 28% by weight, acid value of 25 and hydroxyl value of 32.

50 parts by weight each of the polyester resins A and B thus obtained were mixed by means of a Henschel mixer to obtain binder resin No. 1, having Mn of 2,800, Mw of 82,000, Tg of 60° C., THF-insoluble matter of 14% by weight, acid value of 26 and hydroxyl value of 36.

Resin Production Examples 2 to 4

Polycondensation reaction was carried out in the same manner as in Production Example 1 except that the acid component and alcohol component of the first polyester resin A and second polyester resin B were changed, to obtain binder resin Nos. 2 to 4 as shown in Table 1.

| | |
|---|---|
| Isophthalic acid | 30 mol % |
| Terephthalic acid | 18 mol % |
| n-Dodecenylsuccinic acid | 10 mol % |
| Bisphenol derivative represented by Formula (A) | |
| (R: propylene group; x + y = 2.2) | 30 mol % |
| (R: ethylene group; x + y = 2.2) | 12 mol % |

Using the above monomers, polycondensation reaction was carried out in the same manner as in Production Example 1 to obtain a polyester resin having Mn of 2,200, Mw of 20,000, Tg of 56° C., THF-insoluble matter of 2% by weight, acid value of 47 and hydroxyl value of 32. This was designated as binder resin No. 5.

Resin Production Example 6

| | |
|---|---|
| Terephthalic acid | 28 mol % |
| n-Dodecenylsuccinic acid | 6 mol % |
| Trimellitic anhydride | 6 mol % |
| Bisphenol derivative represented by Formula (A) | |
| (R: propylene group; x + y = 2.2) | 35 mol % |
| (R: ethylene group; x + y = 2.2) | 25 mol % |

Using the above monomers, polycondensation reaction was carried out in the same manner as in Production Example 1 to obtain a polyester resin having Mn of 4,500, Mw of 80,000, Tg of 68° C., THF-insoluble matter of 32% by weight, acid value of 14 and hydroxyl value of 23. This was designated as binder resin No. 6.

Resin Production Example 7

| | |
|---|---|
| Terephthalic acid | 28 mol % |
| Adipic acid | 12 mol % |
| Pentaerythritol | 5 mol % |
| Bisphenol derivative represented by Formula (A) | |

-continued

| | |
|---|---|
| (R: propylene group; x + y = 2.2) | 35 mol % |
| (R: ethylene group; x + y = 2.2) | 20 mol % |

Using the above monomers, polycondensation reaction was carried out in the same manner as in Production Example 1 to obtain a polyester resin having Mn of 3,400, Mw of 39,000, Tg of 62° C., THF-insoluble matter of 20% by weight, acid value of 28 and hydroxyl value of 47. This was designated as binder resin No. 7 (Comparative Example).

EXAMPLE 1

| Example 1 | (by weight) |
|---|---|
| Binder resin No. 1 | 100 parts |
| Azo type iron complex compound (1) | 1 part |
| Magnetic iron oxide (average particle diameter: 0.2 $\mu$m; Hc: 120 oersted; $\sigma$s: 65 emu/g; $\sigma$r: 7 emu/g) | 90 parts |
| Low-molecular weight polypropylene wax | 4 parts |

A mixture of the above materials was melt-kneaded using a twin-screw extruder heated to 130° C. The resulting kneaded product was cooled, and then crushed using a hammer mill. Thereafter the crushed product was finely pulverized using a Jet mill. The resulting finely pulverized product was classified using an air classifier to obtain a magnetic toner with a weight average particle diameter of 6.3 $\mu$m. Molecular weight of THF-soluble matter of this toner was measured to obtain the results that Mw was 770,000, Mw/Mn was 183, the low-molecular weight region component having a molecular weight of less than 150,000 was in a content of 85%, the medium-molecular weight region component having a molecular weight of from 150,000 to 500,000 was in a content of 5%, and the high-molecular weight region component having a molecular weight of more than 500,000 was in a content of 10%. In the toner, the THF-insoluble matter of polyester resin was contained in an amount of 4% by weight.

A GPC chart of the THF-insoluble matter of the toner obtained is shown in FIG. 1.

To 100 parts by weight of this magnetic toner, 1.0 part by weight of a hydrophobic fine dry-process silica powder (BET specific surface area: 300. $m^2/g$) was externally added using a Henschel mixer to produce a magnetic toner.

Using this magnetic toner, image characteristics were evaluated by a digital copying machine GP-55, manufactured by CANON INC. Good results as shown in Table 3 were obtained. The fixing assembly of the digital copying machine GP-55 was detached, and an external driving and temperature control function was attached, where fixing tests were made under different fixing speeds to obtain good results as shown in Table 3.

EXAMPLES 2 TO 4

Magnetic toners were produced in the same manner as in Example 1 except that the binder resin used therein was replaced with binder resins Nos. 2 to 4, respectively. The molecular weights of THF-soluble matter in the toner and the proportion of THF-insoluble matter of polyester resin were as shown in Table 2. Fixing tests were made in the same manner as in Example 1 to obtain good results as shown in Table 3.

EXAMPLES 5 AND 6

Magnetic toners were produced in the same manner as in Example 1 except that the azo type iron complex compound (1) used therein was replaced with azo type iron complex compounds (2) and (3), respectively. The molecular weights of THF-soluble matter in the toner and the proportion of THF-insoluble matter of polyester resin were as shown in Table 2. Fixing tests were made in the same manner as in Example 1 to obtain good results as shown in Table 3.

EXAMPLE 7

A magnetic toner was produced in the same manner as in Example 1 except that the binder resin and azo type iron complex compound (1) used therein were replaced with binder resin No. 2 and azo type iron complex compound (4), respectively. The molecular weights of THF-soluble matter in the toner and the proportion of THF-insoluble matter of polyester resin were as shown in Table 2. Fixing tests were made in the same manner as in Example 1 to obtain good results as shown in Table 3.

EXAMPLE 8

A magnetic toner was produced in the same manner as in Example 1 except that the binder resin and azo type iron complex compound (1) used therein were replaced with binder resin No. 3 and azo type iron complex compound (5), respectively. The molecular weights of THF-soluble matter in the toner and the proportion of THF-insoluble matter of polyester resin were as shown in Table 2. Fixing tests were made in the same manner as in Example 1 to obtain good results as shown in Table 3.

EXAMPLE 9

A magnetic toner was produced in the same manner as in Example 1 except that the binder resin and azo type iron complex compound (1) used therein were replaced with binder resin No. 4 and azo type iron complex compound (6), respectively. The molecular weights of THF-soluble matter in the toner and the proportion of THF-insoluble matter of polyester resin were as shown in Table 2. Fixing tests were made in the same manner as in Example 1 to obtain good results as shown in Table 3.

COMPARATIVE EXAMPLE 1

A magnetic toner was produced in the same manner as in Example 1 except that the azo type iron complex compound (1) used therein was replaced with 2 parts by weight of 3,5-di-tert-butylsalicylic acid chromium complex compound. The molecular weights of THF-soluble matter in the toner and the proportion of THF-insoluble matter of polyester resin were as shown in Table 2. Fixing tests were made in the same manner as in Example 1 to obtain the results as shown in Table 4.

COMPARATIVE EXAMPLE 2

A magnetic toner was produced in the same manner as in Example 1 except that the binder resin used therein was replaced with binder resin No. 5. The molecular weights of THF-soluble matter in the toner and the proportion of THF-insoluble matter of polyester resin were as shown in Table 2. Fixing tests were made in the same manner as in Example 1 to obtain the results as shown in Table 4.

COMPARATIVE EXAMPLE 3

A magnetic toner was produced in the same manner as in Example 1 except that the binder resin used therein was replaced with binder resin No. 6. The molecular weights of THF-soluble matter in the toner and the proportion of THF-insoluble matter of polyester resin were as shown in Table 2. Fixing tests were made in the same manner as in Example 1 to obtain the results as shown in Table 4.

COMPARATIVE EXAMPLE 4

A magnetic toner was produced in the same manner as in Example 1 except that the binder resin used therein was replaced with binder resin No. 7. The molecular weights of THF-soluble matter in the toner and the proportion of THF-insoluble matter of polyester resin were as shown in Table 2. Fixing tests were made in the same manner as in Example 1 to obtain the results as shown in Table 4.

TABLE 1

Properties of Binder Resin

| Binder resin | Molecular weight | | Tg | Acid value | OH value | THF-insoluble matter |
|---|---|---|---|---|---|---|
| No. | Mn | Mw | (°C.) | (mgKOH/g) | (mgKOH/g) | (wt. %) |
| 1 | 3,800 | 82,000 | 60 | 26 | 36 | 14 |
| 2 | 3,900 | 120,000 | 63 | 17 | 30 | 27 |
| 3 | 2,500 | 41,000 | 55 | 36 | 42 | 8 |
| 4 | 2,700 | 79,000 | 58 | 28 | 35 | 21 |
| 5 | 2,200 | 20,000 | 56 | 47 | 32 | 2 |
| 6 | 4,500 | 80,000 | 68 | 14 | 23 | 32 |
| 7 | 3,400 | 39,000 | 62 | 28 | 47 | 20 |

TABLE 2

Properties of Polyester Resin in Toner

| | GPC measurements of THF-soluble matter in toner | | | | | | | |
|---|---|---|---|---|---|---|---|---|
| | | | Component with molecular weight of: | | | Resin component | | |
| | Mw | Mw/Mn | less than 150,000 (%) | 150,000 to 500,000 (%) | more than 500,000 (%) | Acid value (mgKOH/g) | OH value (mgKOH/g) | THF-insoluble matter (wt. %) |
| Example: | | | | | | | | |
| 1 | 770,000 | 183 | 85 | 5 | 10 | 26 | 36 | 4 |
| 2 | 1,420,000 | 309 | 71 | 5 | 24 | 17 | 30 | 8 |
| 3 | 420,000 | 136 | 91 | 4 | 5 | 36 | 42 | 1 |
| 4 | 630,000 | 166 | 79 | 8 | 13 | 28 | 35 | 6 |
| 5 | 780,000 | 190 | 82 | 5 | 13 | 26 | 36 | 4 |
| 6 | 760,000 | 177 | 88 | 4 | 8 | 26 | 36 | 4 |
| 7 | 1,210,000 | 252 | 73 | 5 | 22 | 17 | 30 | 8 |
| 8 | 440,000 | 138 | 90 | 4 | 6 | 26 | 36 | 1 |
| 9 | 620,000 | 163 | 80 | 8 | 12 | 26 | 36 | 6 |
| Comparative Example: | | | | | | | | |
| 1 | 700,000 | 140 | 61 | 20 | 19 | 25 | 36 | 16 |
| 2 | 80,000 | 27 | 95 | 3 | 2 | 47 | 32 | 0 |
| 3 | 160,000 | 39 | 80 | 12 | 8 | 14 | 23 | 11 |
| 4 | 120,000 | 32 | 88 | 7 | 5 | 28 | 47 | 7 |

TABLE 3

| | Fixing performance (Fixable temperature range in external fixing assembly) | | | | Image characteristics (Evaluation by GP-55) | | | | | | |
|---|---|---|---|---|---|---|---|---|---|---|---|
| | Fixing speed: 100 mm/sec | | Fixing speed: 500 mm/sec | | Initial stage | | | After 20,000 sheets copying | | | Envi- |
| | Solid black density | Halftone density | Solid black density | Halftone density | Image den- | | Den- sity grada- | Image den- | | Den- sity grada- | ron- mental sta- |
| Example: | 1.3 | 0.5 | 1.3 | 0.5 | sity | Fog | tion | sity | Fog | tion | bility |
| 1 | 120–220° C. | 120–220° C. | 140–240° C. | 140–240° C. | 1.45 | A | A | 1.45 | A | A | A |
| 2 | 130–220° C. | 130–220° C. | 150–240° C. | 150–240° C. | 1.45 | B | A | 1.43 | B | A | A |
| 3 | 120–210° C. | 120–210° C. | 140–230° C. | 140–230° C. | 1.44 | A | A | 1.44 | A | A | B |
| 4 | 125–215° C. | 125–215° C. | 145–235° C. | 145–235° C. | 1.45 | A | A | 1.45 | A | A | A |
| 5 | 120–220° C. | 120–220° C. | 140–240° C. | 140–240° C. | 1.45 | A | A | 1.45 | A | A | A |
| 6 | 120–220° C. | 120–220° C. | 140–240° C. | 140–240° C. | 1.44 | A | A | 1.44 | A | A | A |
| 7 | 130–220° C. | 130–220° C. | 150–240° C. | 150–240° C. | 1.43 | B | A | 1.42 | B | A | A |
| 8 | 120–210° C. | 120–210° C. | 140–230° C. | 140–230° C. | 1.43 | A | A | 1.43 | A | A | B |
| 9 | 125–215° C. | 125–215° C. | 145–235° C. | 145–235° C. | 1.44 | A | A | 1.44 | A | A | A |

TABLE 4

| | Fixing performance (Fixable temperature range in external fixing assembly) | | | | Image characteristics (Evaluation by GP-55) | | | | | | |
|---|---|---|---|---|---|---|---|---|---|---|---|
| | Fixing speed: 100 mm/sec | | Fixing speed: 500 mm/sec | | Initial stage | | | After 20,000 sheets copying | | | Envi- |
| Com- parative | Solid black density | Halftone density | Solid black density | Halftone density | Image den- | | Den- sity grada- | Image den- | | Den- sity grada- | ron- mental sta- |
| Example: | 1.3 | 0.5 | 1.3 | 0.5 | sity | Fog | tion | sity | Fog | tion | bility |
| 1 | 160–220° C. | 170–210° C. | 180–240° C. | 190–240° C. | 1.42 | B | A | 1.4 | B | A | B |
| 2 | 130–180° C. | 140–180° C. | 150–200° C. | 150–190° C. | 1.34 | B | C | 1.3 | B | C | D |
| 3 | 150–200° C. | 160–200° C. | 170–220° C. | 180–220° C. | 1.38 | D | C | 1.36 | E | D | D |
| 4 | 145–200° C. | 150–200° C. | 170–220° C. | 180–220° C. | 1.35 | C | B | 1.31 | C | C | E |

Image density was measured using Macbeth RD918 (manufactured by Macbeth Co.)

Evaluation on fog was made in the following way. Fog density (%) was calculated from differences between the whiteness of white background areas of printed images and the whiteness of the transfer paper as measured using REFLECTOMETER (manufactured by Tokyo Denshoku Co., Ltd.), to make evaluation on the fog according to the following criteria.

Evaluation criteria:

A . . . less than 1.2%

B . . . 1.2 to less than 1.8%

C . . . 1.8 to less than 2.5%

D . . . 2.5 to less than 4.0%

E . . . 4.0% or more

Density gradation was visually evaluated by comparing printed images with original images, according to five ranks of A (excellent), B. (good), C (average), D (a little poor) and E (poor).

With regard to environmental stability, image reproduction was tested after the toner was left to stand for 24 hours in an environment of high temperature and high humidity (30° C., 85% RH), and image density was evaluated according to the following criteria.

Evaluation criteria:

A . . . Image density is 1.3 or more.

B . . . Image density is 1.2 to less than 1.3

C . . . Image density is 1.1 to less than 1.2

D . . . Image density is 1.0 to less than 1.1

E . . . Image density is less than 1.0

What is claimed is:

1. A toner for developing an electrostatic image, comprising a binder resin, a colorant and a charge control agent, wherein;

said binder resin comprises a polyester resin; said polyester resin having an acid value of from 15 to 40 and a hydroxyl value of 45 or less; and said toner has, in its molecular weight distribution as measured by gel permeation chromatography, tetrahydrofuran-soluble matter having a weight average molecular weight Mw of 100,000 or more, having a ratio of weight average molecular weight Mw to number average molecular weight Mn, Mw/Mn, of not less than 35, containing from 70% to 94% of a low-molecular weight region component having a molecular weight of less than 150,000, containing from 1% to 10% of a medium-molecular weight region component having a molecular weight of from 150,000 to 500,000, and containing from 5% to 25% of a high-molecular weight region component having a molecular weight of more than 500,000; said high-molecular weight region component being more than said medium-molecular weight region component.

2. The toner according to claim 1, wherein said charge control agent is an azo type iron complex compound.

3. The toner according to claim 2, wherein said azo type iron complex compound is a compound represented by the following formula:

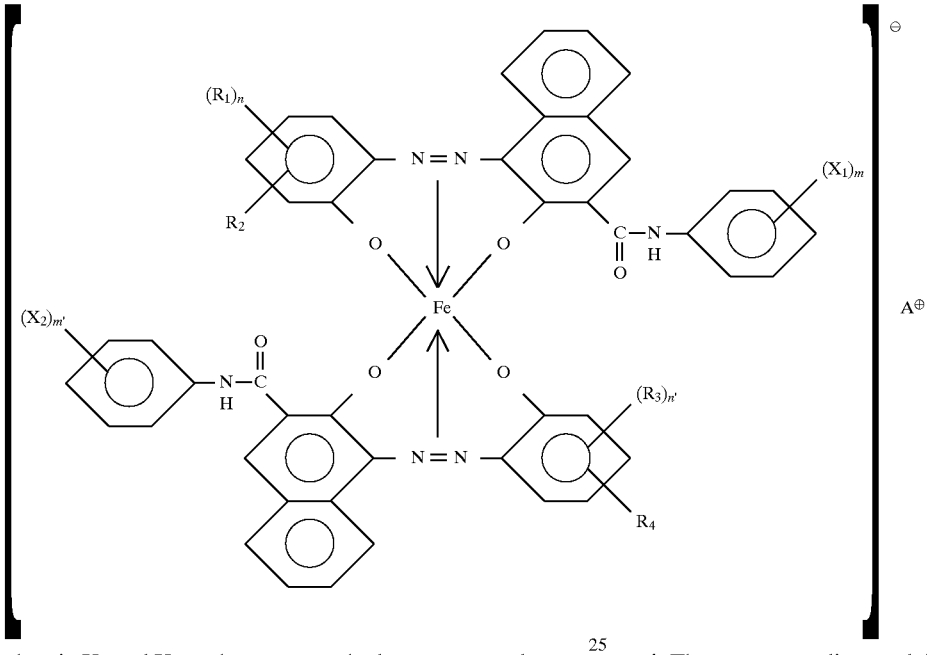

wherein $X_1$ and $X_2$ each represent a hydrogen atom, a lower alkyl group, a lower alkoxyl group, a nitro group or a halogen atom, and $X_1$ and $X_2$ may be the same or different from each other; m and m' each represent an integer of 1 to 3; $R_1$ and $R_3$ each represent a hydrogen atom, an alkyl group having 1 to 18 carbon atoms, an alkenyl group, a sulfonamide group, a mesyl group, a sulfonic acid group, a carboxylate group, a hydroxyl group, an alkoxyl group having 1 to 18 carbon atoms, an acetylamino group, a benzoylamino group or a halogen atom, and $R_1$ and $R_3$ may be the same or different from each other; n and n' each represent an integer of 1 to 3; $R_2$ and $R_4$ each represent a hydrogen atom or a nitro group; and $A^+$ represents a hydrogen ion, a sodium ion, a potassium ion or an ammonium ion.

4. The toner according to claim 1, wherein said polyester resin has tetrahydrofuran-insoluble matter in a proportion of from 0% by weight to 10% by weight in the toner.

5. The toner according to claim 3, wherein said azo type iron complex compound is contained in an amount of from 0.1 part by weight to 10 parts by weight based on 100 parts by weight of the binder resin.

6. The toner according to claim 3, wherein said azo type iron complex compound is contained in an amount of from 0.1 part by weight to 5 parts by weight based on 100 parts by weight of the binder resin.

7. The toner according to claim 3, wherein said azo type iron complex compound is a compound selected from the group consisting of the following azo type iron complex compounds (1) to (6):

Azo type iron complex compound (1)

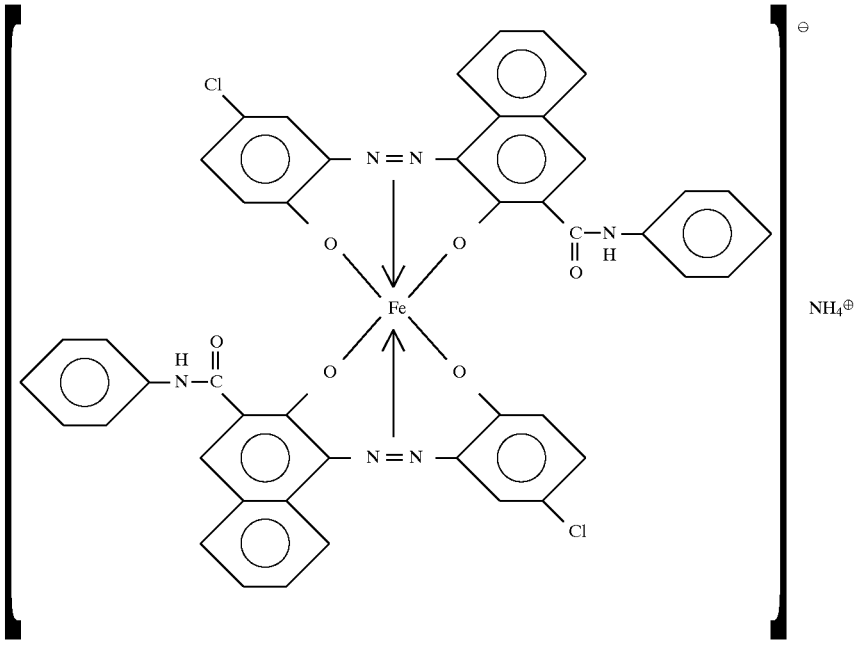

-continued
Azo type iron complex compound (2)
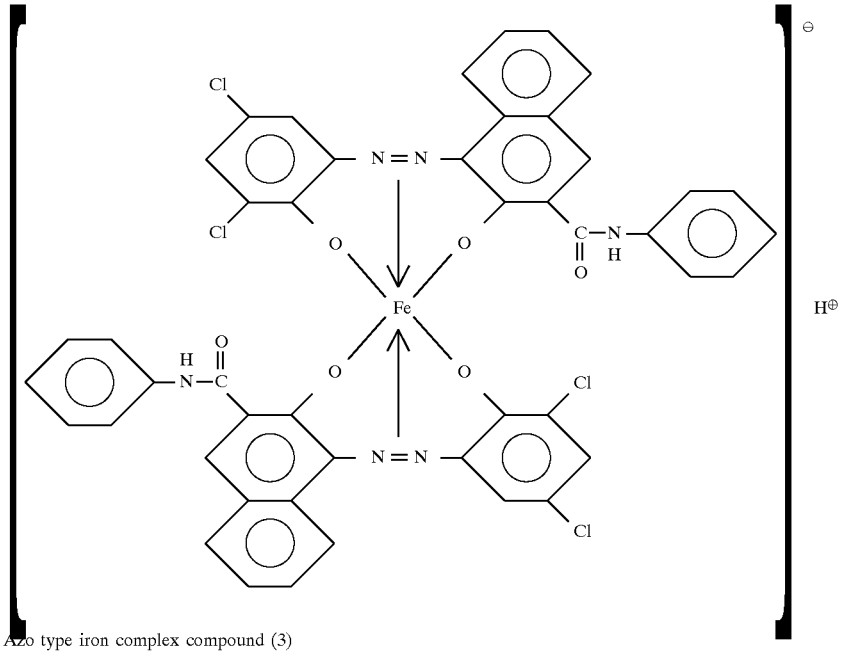
Azo type iron complex compound (3)
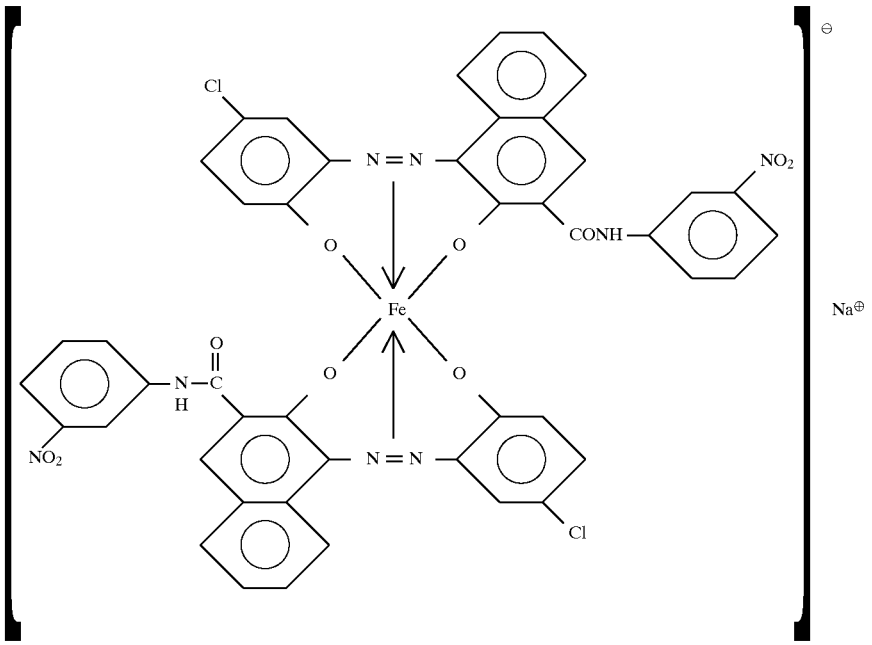

-continued
Azo type iron complex compound (4)
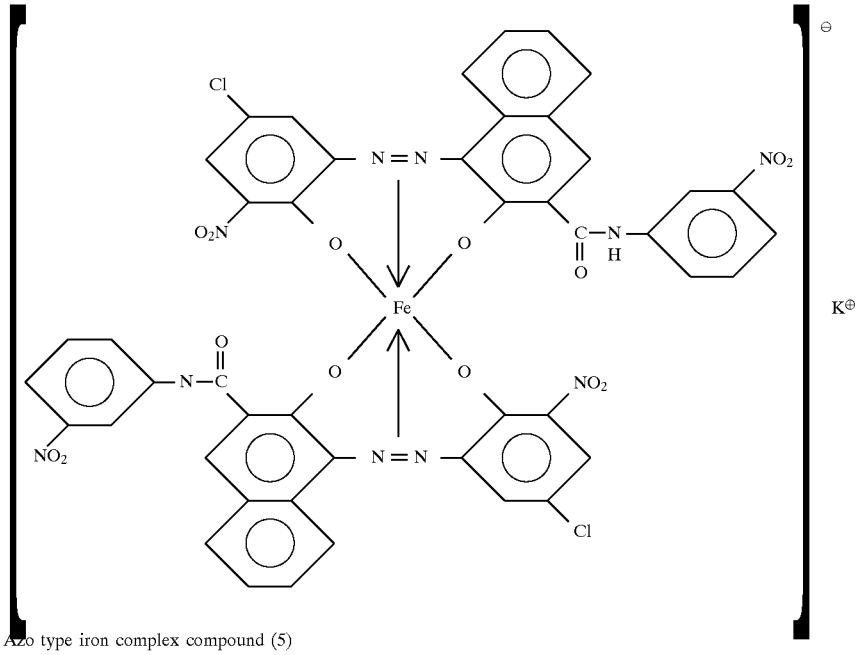
Azo type iron complex compound (5)
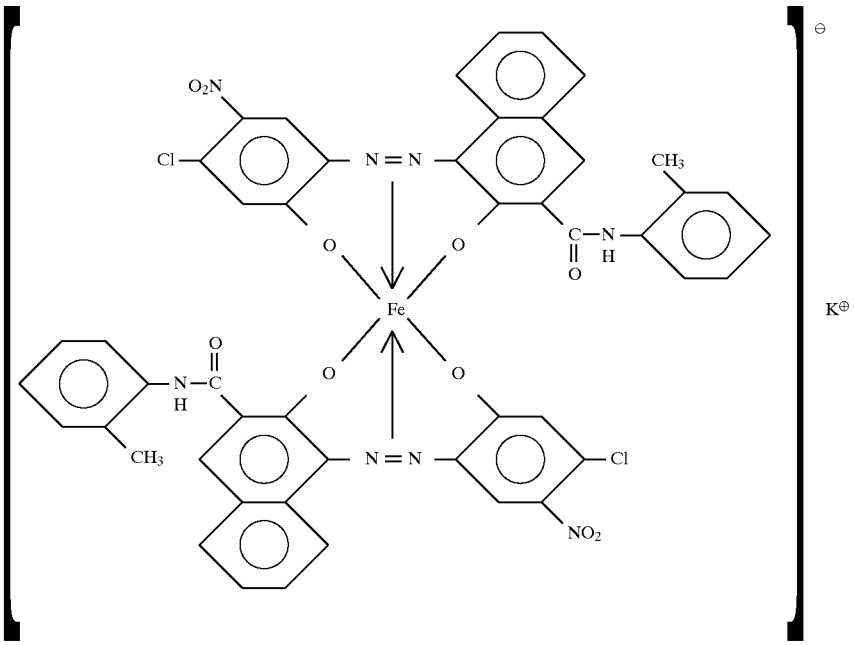

-continued

Azo type iron complex compound (6)

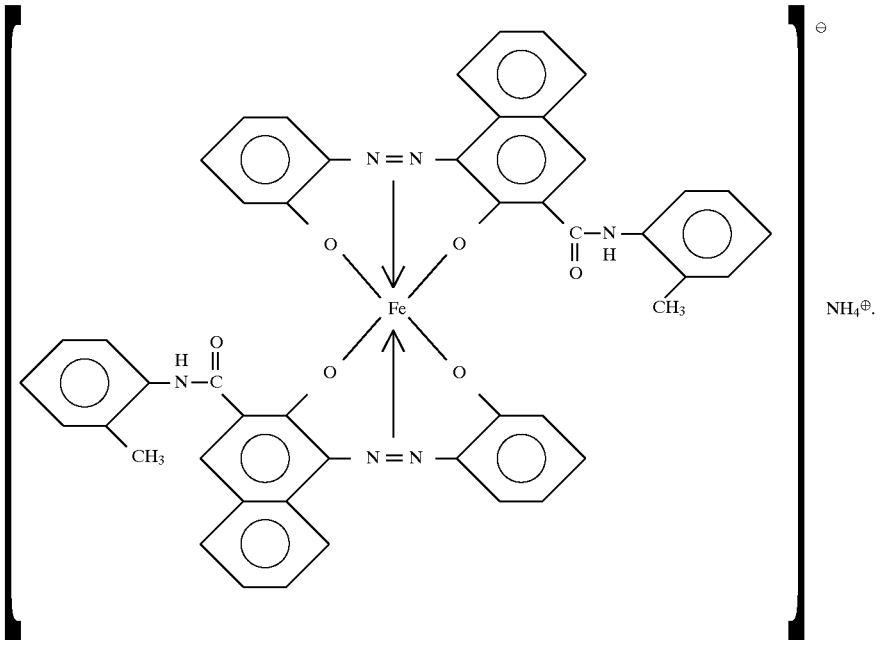

8. The toner according to claim 1, wherein said colorant is a magnetic material.

9. The toner according to claim 8, wherein said magnetic material is contained in an amount of from 10 parts by weight to 200 parts by weight based on 100 parts by weight of the binder resin.

10. The toner according to claim 1, wherein the toner has tetrahydrofuran-soluble matter having a weight average molecular weight Mw of from 200,000 to 3,000,000.

11. The toner according to claim 1, wherein the toner has tetrahydrofuran-soluble matter having a value of Mw/Mn of from 40 to 400.

12. The toner according to claim 1, wherein in the tetrahydrofuran-soluble matter of the toner said high-molecular weight region component having a molecular weight of more than 500,000 is more than said medium-molecular weight region component having a molecular weight of from 150,000 to 500,000 by 1% to 20%.

13. The toner according to claim 1, wherein said binder resin contains tetrahydrofuran-insoluble matter in an amount not more than 10% by weight.

14. The toner according to claim 1, wherein said binder resin contains no tetrahydrofuran-insoluble matter or contains tetrahydrofuran-insoluble matter in an amount not more than 5% by weight.

15. The toner according to claim 1, wherein said polyester resin has a hydroxyl value of from 5 to 42.

16. The toner according to claim 1, wherein said polyester resin has a glass transition temperature of from 40° C. to 80° C.

17. The toner according to claim 1 wherein said polyester resin has a glass transition temperature of from 45° C. to 75° C.

18. The toner according to claim 1, wherein the toner has toner particles produced by melt-kneading a mixture containing at least a polyester resin containing 5% by weight to 30% by weight of tetrahydrofuran-insoluble matter, the colorant and the charge control agent, cooling the kneaded product obtained, and pulverizing the cooled product obtained.

19. The toner according to claim 18, wherein said polyester resin contains tetrahydrofuran-insoluble matter in an amount of from 10% by weight to 25% by weight.

20. The toner according to claim 1, wherein the toner has toner particles produced by melt-kneading a mixture containing at least (i) a first polyester resin containing no tetrahydrofuran-insoluble matter and containing tetrahydrofuran-soluble matter having a weight average molecular weight Mw of from 7,000 to 100,000 and a number average molecular weight Mn of from 2,000 to 10,000, (ii) a second polyester resin containing 10% by weight to 50% by weight of tetrahydrofuran-insoluble matter and containing tetrahydrofuran-soluble matter having a weight average molecular weight Mw of from 30,000 to 500,000 and a number average molecular weight Mn of from 2,500 to 15,000, (iii) the colorant and (iv) the charge control agent, cooling the kneaded product obtained, and pulverizing the cooled product obtained.

21. The toner according to claim 20, wherein said first polyester resin and said second polyester resin are mixed in a weight ratio of from 1:9 to 9:1.

22. The toner according to claim 20, wherein said first polyester resin and said second polyester resin are mixed in a weight ratio of from 2:8 to 8:2.

* * * * *

UNITED STATES PATENT AND TRADEMARK OFFICE

CERTIFICATE OF CORRECTION

PATENT NO. : 5,773,183

DATED : June 30, 1998

INVENTOR(S): TADASHI DOUJO ET AL.

It is certified that error appears in the above-identified patent and that said Letters Patent is hereby corrected as shown below:

COLUMN 4

Line 44, "mol %" should read --mol%--;
Line 45, "molt" should read --mol%--.

COLUMN 9

Compound (5), " 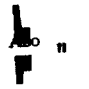 " should read -- 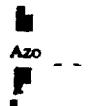 --;

Compound (6), " 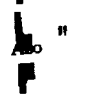 " should read -- 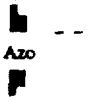 --.

COLUMN 12

Line 40, "phthallmide" should read --phthalimide--;
Line 62, "As" should read --(in the formula, n represents 1 to 5) ¶ As--.

COLUMN 15

Line 12. "α-chlorothyltri-" should read --α-chloroethyltri--.

COLUMN 17

Line 46, "100°" should read --10°--.

COLUMN 18

Line 15, "molt" should read --mol%--;
Line 30, "Table 1." should read --Table 1. ¶ Resin Production Example 5--.

UNITED STATES PATENT AND TRADEMARK OFFICE

CERTIFICATE OF CORRECTION

PATENT NO. : 5,773,183

DATED : June 30, 1998

INVENTOR(S): TADASHI DOUJO ET AL.

It is certified that error appears in the above-identified patent and that said Letters Patent is hereby corrected as shown below:

COLUMN 19

Line 27, "Jet" should read --jet--;
Line 44, "300." should read --300--.

COLUMN 23

Line 57, "B." should read --B--.

COLUMN 31

Line 57, "claim 1" should read --claim 1,--.

Signed and Sealed this

Twenty-third Day of March, 1999

*Attest:*

Q. TODD DICKINSON

*Attesting Officer*

*Acting Commissioner of Patents and Trademarks*